US005264781A

United States Patent [19]

Miller et al.

[11] Patent Number: 5,264,781

[45] Date of Patent: Nov. 23, 1993

[54] CURRENT CONTROL/POWER LIMITER CIRCUIT

[75] Inventors: John M. Miller, Saline; Harold G. Spring, Weidman, both of Mich.

[73] Assignee: Ford Motor Company, Dearborn, Mich.

[21] Appl. No.: 846,139

[22] Filed: Mar. 5, 1992

[51] Int. Cl.[5] ..... G05F 1/40

[52] U.S. Cl. ..... 323/282; 323/283; 323/284; 323/285

[58] Field of Search ..... 323/273, 275, 277, 285, 323/282, 283, 284, 351; 363/95; 330/127

[56] References Cited

U.S. PATENT DOCUMENTS

| | | | |
|---|---|---|---|
| 3,571,689 | 3/1971 | Wise | 321/5 |
| 3,602,804 | 8/1971 | Randall | 323/20 |
| 4,278,930 | 7/1981 | Rogers | 323/285 |
| 4,380,730 | 4/1983 | Morton, Jr. | 323/300 |
| 4,437,043 | 3/1984 | Pitel | 315/308 |
| 4,461,990 | 7/1984 | Bloomer | 323/235 |
| 4,511,836 | 4/1985 | Eriksson | 323/300 |
| 4,580,080 | 4/1986 | Smith | 315/199 |
| 4,672,300 | 6/1987 | Harper | 323/222 |
| 5,006,973 | 4/1991 | Turner | 363/34 |

*Primary Examiner*—Steven L. Stephan
*Assistant Examiner*—Adolf Berhane
*Attorney, Agent, or Firm*—Roger L. May; Paul K. Godwin, Jr.

[57] ABSTRACT

An analog circuit provides selectable current control and power limiting for a connected load. A current control loop is combined with a voltage/power control loop to generate a current level signal via an output transistor to control current flow through a load. Current through a load is monitored with the current control loop maintaining current flow through the load at a selected value. If a selected power level is exceeded, the current is reduced by the voltage/power control loop. Voltage monitoring and feedback is used to control the operating power for a power level control operational amplifier and thereby maintain a selected power level. By providing multiple, voltage dependent gains in the voltage feedback loop, a piecewise linear approximation of a desired power curve can be obtained.

20 Claims, 2 Drawing Sheets $I_L$
100
90
80
70
60
$I_{q_f}$ 50
40
30
20
10
LA
$P_A$
OC
$P_B$
PC
$P_C$
10
20
30
40
50
60
70
80
$V_L$
$V_{q_f}$

CURRENT CONTROL/POWER LIMITER CIRCUIT

BACKGROUND OF THE INVENTION

The present invention relates generally to circuits used to control current levels in connected loads and, more particularly, to current control circuits which not only control current levels in connected loads but also limit the power delivered to such loads. The present invention is particularly applicable to active loads, used for example to test alternators or other power generators; however, it is also generally applicable to regulate and control the operation of other loads such as arc discharge lamps which require both current regulation and power limiting.

A variety of circuits exist in the prior art for current control and/or power limiting in circuit loads. For power limiting, both analog and digital techniques have been applied. Multiplier circuits are commonly used for analog power limiting to multiply signals representative of current by signals representative of voltage and thereby calculate power level signals which are then used to control current and/or voltage to limit power within a load. Unfortunately, such analog power limiter circuits require a substantial amount of circuitry such that a simpler design is desirable.

For digital power limiting, current and voltage signals are converted from analog to digital form and used by a processor to multiply and accumulate power levels being dissipated in a load. The accumulated power levels are then used to control current and/or voltage to limit power within a load. Unfortunately, such digital power limit circuits require substantial software and computing overhead.

Accordingly, there is a need for an improved power limiting circuit. Preferably, such a circuit would provide not only power limiting but also current control in a simplified design for regulating and controlling the operation of loads which require both current regulation and power limiting.

SUMMARY OF THE INVENTION

This need is met in accordance with the present invention by means of an analog circuit which provides selectable current control and also selectable power limiting for a load connected to the circuit. A current control loop is combined with a voltage/power control loop to generate a current level signal via an output transistor to control current flow through a load. Current through a load is monitored with the current control loop maintaining current flow through the load at a selected value. If a selected power level is exceeded, the current is reduced by the voltage/power control loop. Voltage monitoring and feedback is used to control the operating power for a power level control operational amplifier and thereby maintain a selected power level. By providing multiple, voltage dependent gains in the voltage feedback loop, a piecewise linear approximation of a desired power curve can be obtained.

A selectable offset voltage on a current monitor operational amplifier is combined with a selectable power set voltage generated by the load power level control operational amplifier to generate the current level signal as long as the power being dissipated in the load is at or below the power level defined by the power set voltage. The current through the load is monitored by the current monitor operational amplifier and combines with the selectable offset voltage to maintain the current level at the selected level during operation at or below the power level defined by the power set voltage. The voltage across the load is monitored by a voltage monitor operational amplifier which, as noted, provides operating power for the power level control operational amplifier. If the power being dissipated in the load attempts to exceed the selected power level, the operating voltage of the power level control operational amplifier is reduced by the signal generated by the voltage monitor operational amplifier to maintain the selected power level by reducing the current level signal.

In accordance with one aspect of the present invention, a circuit for setting current delivered to a load to a defined current level until a defined load power level is reached, at which point current is controlled to maintain power delivered to the load at the defined load power level comprises load current level signal generator means for generating a current level signal to control current flow through the load. Load power level control means for limiting the power dissipated in the load to the defined load power level is coupled to the load current level signal generator means and includes a load power level operational amplifier for generating a power level output signal from the load power level control means. Voltage monitor means for monitoring voltage across the load is coupled to the load power control means to provide operating power for the load power level operational amplifier and thereby control the power level output signal. Current monitor means provide for monitoring current flow through the load. The current monitor means is coupled to the load current signal generator means for maintaining current flow through the load at the defined current level.

For maximum current limitation purposes, the circuit may further comprise current clamp means coupled to the load current level signal generator means and the current monitor means for clamping the current level signal in the event of excess current flow through the load. Preferably, the current monitor means includes current selector means for selecting the defined current level and the load power level control means includes power selector means for selecting the defined load power level. To provide a piecewise linear approximation of a power curve for the load, the voltage monitor means comprises more than one voltage gain. To provide more than one voltage gain preferably the voltage monitor means comprises a voltage monitor operational amplifier having more than one feedback path, at least one feedback path of the voltage monitor operational amplifier being voltage dependent to shift between voltage gains based on the voltage across the load. In the preferred embodiment, voltage dependency for the at least one feedback path is performed by at least one zener diode included to perform voltage dependent shifting of voltage gains of the voltage monitor operational amplifier.

It is thus a feature of the present invention to provide an improved current control circuit wherein power is also limited to selectable power levels; to provide an improved current control circuit wherein power is also limited to selectable power levels by means of a current monitor/control loop and a voltage monitor/control loop with the voltage monitor/control loop being combined with a power level control circuit by means of providing operating power for an operational amplifier of the power level control circuit; and, to provide an improved current control circuit wherein power is also limited to selectable power levels by means of a current monitor/control loop and a voltage monitor/control loop with the voltage monitor/control loop being combined with a power level control circuit by means of providing operating power for an operational amplifier of the power level control circuit wherein multiple voltage dependent gains are provided for the voltage monitor/control loop to define a piecewise linear approximation of a desired power curve.

Other features and advantages of the invention will be apparent from the following description, the accompanying drawings and the appended claims.

Detailed Description of the Invention

Figure 1:
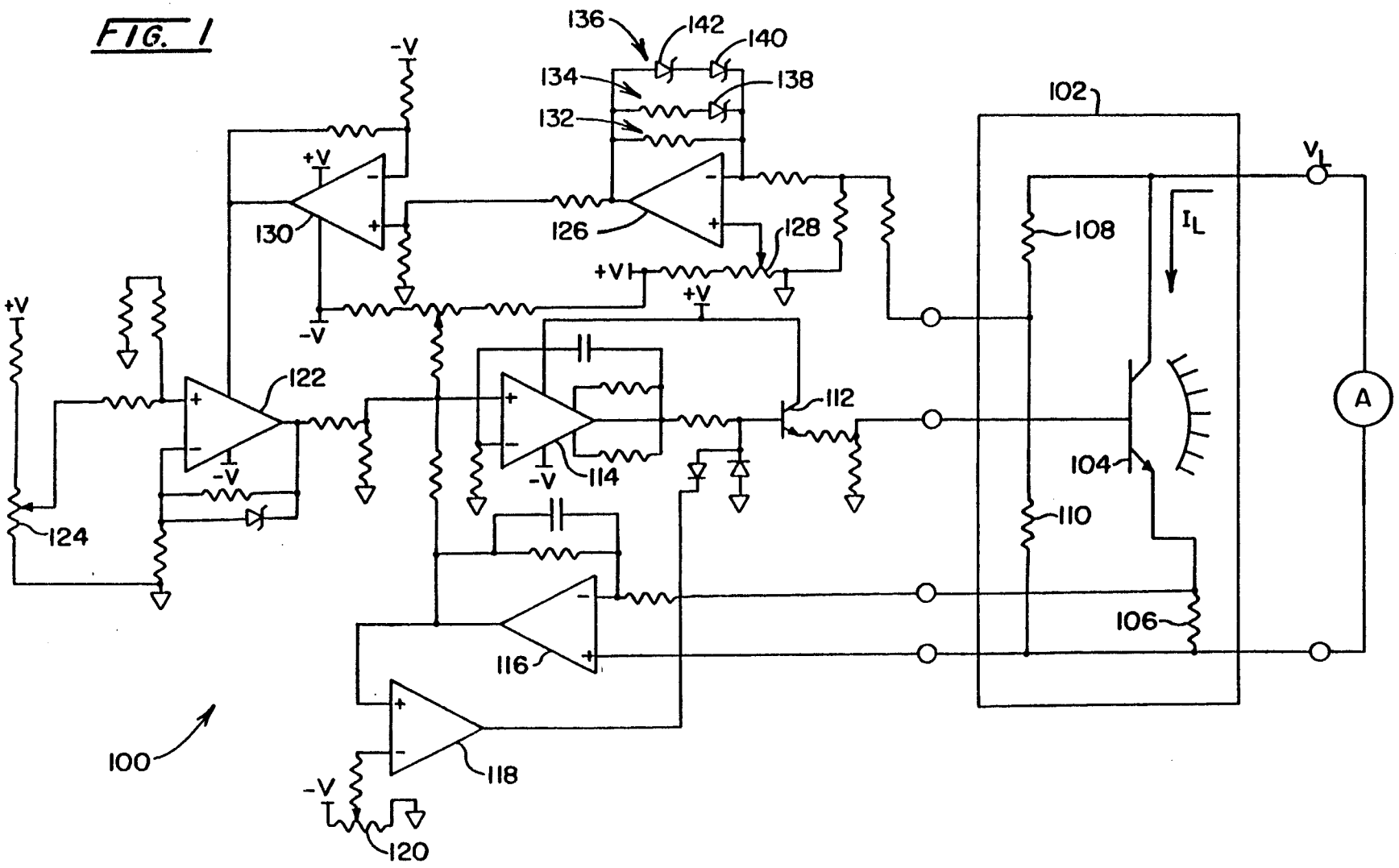
FIG. 1 is a schematic diagram of a circuit operable in accordance with the present invention.

While being generally applicable for controlling loads such as arc lamps which require both current regulation and power limiting, the present invention is particularly applicable for controlling active loads used for example to test alternators or other power generators and accordingly will be described herein with reference to this application. Operation of the present invention will now be described with reference to the drawings wherein FIG. 1 is a schematic diagram of a circuit 100 which is connected to an active load 102. An alternator A or other power generator or device to be tested is connected to the active load 102 which is then controlled to provide appropriate load current $I_L$ and load voltage $V_L$ for test purposes, evaluation or otherwise as required.

The active load 102 comprises a transistor "stick" 104, a current sense resistor 106 and a pair of voltage divider resistors 108, 110. The active load 102 is controlled via load current level signal generator means comprising an output transistor 112 and a summing operational amplifier 114 in the illustrated embodiment which provides for generating a current level signal to drive the transistor stick 104 to control the load current $I_L$. While current flows through the voltage divider resistors 108, 110, this current is extremely small and can be ignored in comparison to the load current $I_L$.

Current monitor means comprising a current monitor operational amplifier 116 in the illustrated embodiment is connected across the current sense resistor 106 for monitoring load current $I_L$. The output of the current monitor operational amplifier 116 is connected to the input of the summing operational amplifier 114 of the current level signal generator means. Current clamp means comprising a current clamp operational amplifier 118 is connected between the output of the current monitor operational amplifier 116 and the output transistor 112 for clamping the current level signal to prevent excess current flow through the active load 102. A potentiometer 120 is used to set an offset voltage for the current clamp operational amplifier 118 and also the current monitor operational amplifier 116. The offset voltage selected by the potentiometer 120 is used to set the defined or quiescent current level through the active load 102.

Load power level control means comprising a load power level operational amplifier 122 in the illustrated embodiment is coupled to the summing operational amplifier 114 of the current level signal generator means and generates a power level output signal for limiting the power dissipated in the active load 102. Circuit means comprising a potentiometer 124 in the illustrated embodiment is provided for setting a defined dissipation power level for a connected load, such as the active load 102.

Voltage monitor means comprising a voltage monitor operational amplifier 126 in the illustrated embodiment is connected to the voltage divider resistors 108, 110 to monitor the voltage across the active load 102, i.e. the load voltage $V_L$. A potentiometer 128 is connected to select an offset voltage for the voltage monitor operational amplifier 126. The output voltage of the voltage monitor operational amplifier 126, including the offset voltage set by the potentiometer 128, is passed through a buffer operational amplifier 130 to provide operating power for the load power level control operational amplifier 122. This configuration of the voltage monitor operational amplifier 126, the buffer operational amplifier 130 and the load power level operational amplifier 122 control the power level output signal to limit power dissipation in the active load 102.

Figure 2:
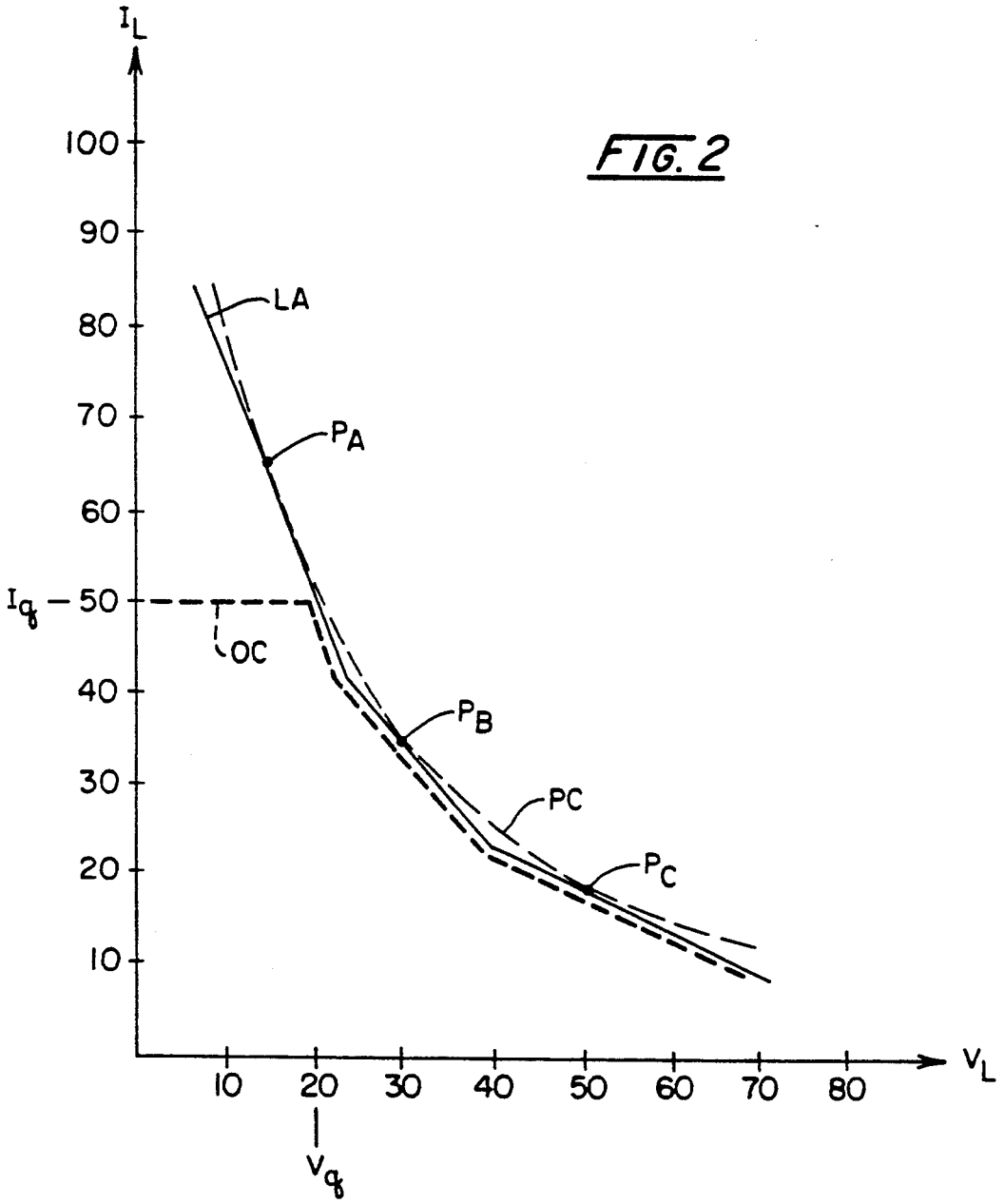
FIG. 2 is a graph of a power dissipation curve and a piecewise linear approximation of that curve performed in accordance with the present invention.

The voltage monitor operational amplifier 126 comprises means for defining more than one voltage gain to provide a piecewise linear approximation LA shown in solid lines in FIG. 2 of a power curve PC shown in light dashed lines in FIG. 2 for the active load 102. In particular, the voltage monitor operational amplifier 126 has more than one feedback path with three feedback paths 132, 134 and 136 being illustrated in the embodiment of FIG. 1. While other feedback path selection means can be provided, it is preferred to include at least one voltage dependent feedback path such that the feedback paths are shifted between voltage gains based on the voltage across the active load 102, i.e. the load voltage $V_L$. As shown in FIG. 1, the voltage dependent feedback paths 134, 136 include one and two Zener diodes 138 and 140, 142, respectively.

Operation of the circuit of FIG. 1 will now be more fully described with reference to FIGS. 1 and 2. While a variety of power levels can be selected by operation of the potentiometer 124, the power curve PC shown in FIG. 2 is set for 1000 watts or 1 kilowatt. To define the piecewise linear approximation LA of the power curve PC, three power points along the power curve PC are selected, such as $P_A$ ($I_L \neq 67$ amps, $V_L \neq 15$ volts), $P_B$ ($I_L \neq 33$ amps, $V_L \neq 30$ volts) and $P_C$ ($I_L \neq 20$ amps, $V_L \neq 50$ volts). Linear approximations are then made by selecting line segments which are centered on the points $P_A$, $P_B$ and $P_C$ and selecting corresponding gains for the voltage monitor operational amplifier 126 for the corresponding portions of the curve, i.e. the gains and breakpoints are selected such that the slope of the linear segments evaluated at the power points $P_A$, $P_B$ and $P_C$ are matched. Gain selection is by means of the voltage dependent feedback paths 132, 134 and 136 as previously described.

The load current $I_L$ to be maintained by the circuit 100 is selected by setting the potentiometer 120. For the illustration of FIG. 2, the load current $I_L$ has been set to equal a quiescent current $I_q$ of approximately 50 amps with a corresponding quiescent voltage $V_q$ of approximately 20 volts. The circuit 100 regulates the load current $I_L$ to the level selected by the setting of the potentiometer 120 as long as the power dissipated in the active load 102 does not exceed the power level set by the potentiometer 124, i.e. as long as the load voltage $V_L<V_q$. For this range of load voltage, $0<V_L<V_q$, the output of the voltage control loop including the operational amplifiers 126, 130 and 122 remains at the voltage level set by the potentiometer 124 which offsets the operational amplifiers 126, 122.

The voltage level set by the potentiometer 124 is selected to initially define a high voltage level such that the output of the operational amplifier 122 is completely defined by the potentiometer 124. During such conditions, the output of the circuit 100 is controlled by the current loop made up by the operational amplifiers 116 and 114 and the transistor 112 to maintain load current $I_L$ at the set value. The operational amplifiers 114, 116 and 118 operate with a large offset to the output transistor 112 to bias it. The control of the current loop acts to either increase or decrease the drive to the output transistor 112 to maintain the load current $I_L$ at the set value.

As the load voltage $V_L$ increases to $V_q$, the negative feedback on the operational amplifier 126 of the voltage feedback loop reduces the voltage level of the operating power provided to the operational amplifier 122 until it equals the power set point defined by the setting of the potentiometer 124. At this point, operation has reached the power curve PC. If the load voltage $V_L$ on the active load 102 continues to rise beyond $V_q$, the load current $I_L$ is reduced below the set current level $I_q$ with the reduction in current following the piecewise linear approximation curve LA under the control of the voltage feedback loop. Operation of the circuit as described is illustrated by the operating curve OC shown in FIG. 2 by a heavy dashed line. Similar operations and operating curves for other current set points will be apparent from the foregoing description.

It is thus apparent that an improved current control and power limit circuit has been described. The invention provides current/power control using only linear operational amplifiers and the unique arrangement of controlling the output of an operational amplifier via its power input to intercouple the current and power control functions. Having thus described the present invention in detail and by reference to preferred embodiments thereof, it will be apparent that modifications and variations are possible without departing from the scope of the invention defined in the appended claims.

What is claimed is:

1. A circuit for setting current delivered to a load to a defined current level until a defined load power level is reached, at which point current is controlled to maintain power delivered to said load at said defined load power level, said circuit comprising:

load current level signal generator means for generating a current level signal to control current flow through said load;

load power level control means for limiting the power dissipated in said load to said defined load power level, said load power level control means being coupled to said load current level signal generator means and including a load power level operational amplifier for generating a power level output signal from said load power level control means;

voltage monitor means for monitoring voltage across said load, said voltage monitor means being coupled to said load power control means to provide operating power for said load power level operational amplifier and thereby control said power level output signal; and current monitor means for monitoring current flow through said load, said current monitor means being coupled to said load current level signal generator means for maintaining current flow through said load at said defined current level.

2. A circuit for setting current delivered to a load as claimed in claim 1 further comprising current clamp means coupled to said load current level signal generator means and said current monitor means for clamping said current level signal to prevent excess current flow through said load.

3. A circuit for setting current delivered to a load as claimed in claim 1 wherein said current monitor means includes current selector means for selecting said defined current level.

4. A circuit for setting current delivered to a load as claimed in claim 3 wherein said load power level control means includes power selector means for selecting said defined load power level.

5. A circuit for setting current delivered to a load as claimed in claim 1 wherein said voltage monitor means comprises means for defining more than one voltage gain to provide a piecewise linear approximation of a power curve for said load.

6. A circuit for setting current delivered to a load as claimed in claim 1 wherein said voltage monitor means comprises a voltage monitor operational amplifier having more than one feedback path, at least one feedback path of said voltage monitor operational amplifier being voltage dependent to shift between voltage gains based on the voltage across said load.

7. A circuit for setting current delivered to a load as claimed in claim 6 wherein said at least one feedback path includes at least one zener diode to perform voltage dependent shifting of voltage gains of said voltage monitor operational amplifier.

8. A circuit for setting current delivered to a load as claimed in claim 1 wherein said load current level signal generator means comprises an output transistor for generating said current level signal.

9. A circuit for setting current delivered to a load as claimed in claim 1 wherein an offset voltage in said current monitor means sets said defined current level for current flow through said load.

10. A circuit for setting current delivered to a load as claimed in claim 9 wherein an offset voltage in said voltage monitor means sets a base level of operating power for said load power level operational amplifier.

11. A circuit for setting current delivered to a load to a defined current level until a defined load power level is reached, at which point current is controlled to maintain power delivered to said load at said defined load power level, said circuit comprising:

a summing operational amplifier connected to drive an output transistor to generate a current level signal to control current flow through said load;

a load power level control operational amplifier having an output connected to said summing operational amplifier and an input connected to circuit means for setting a defined load power level;

a voltage monitor operational amplifier connected to monitor voltage across said load and coupled to provide operating power for said load power level control operational amplifier; and a current monitor operational amplifier connected to monitor current flow through said load, said current monitor operational amplifier having an output connected to said summing operational amplifier and including current set means connected to set said defined level of current flow through said load.

12. A circuit for setting current delivered to a load as claimed in claim 11 further comprising a current clamp operational amplifier connected to said current monitor operational amplifier and said output transistor for clamping said current level signal in the event of excess current flow through said load.

13. A circuit for setting current delivered to a load as claimed in claim 12 wherein said current set means comprises a potentiometer connected to select an offset voltage for said current clamp operational amplifier and thereby select said defined level of current flow through said load.

14. A circuit for setting current delivered to a load as claimed in claim 11 wherein said current set means provides for selecting said defined current level.

15. A circuit for setting current delivered to a load as claimed in claim 11 wherein said voltage monitor operational amplifier defines more than one voltage gain to provide a piecewise linear approximation of a power curve for said load.

16. A circuit for setting current delivered to a load as claimed in claim 15 wherein said voltage monitor operational amplifier has more than one feedback path, at least one feedback path of said voltage monitor operational amplifier being voltage dependent to shift between voltage gains based on the voltage across said load.

17. A circuit for setting current delivered to a load as claimed in claim 16 wherein said at least one feedback path includes at least one zener diode to perform voltage dependent shifting of voltage gains of said voltage monitor operational amplifier.

18. A circuit for setting current delivered to a load as claimed in claim 17 wherein said voltage monitor operational amplifier has three feedback paths to define a three piece piecewise linear approximation of a power curve for said load.

19. A circuit for setting current delivered to a load as claimed in claim 11 wherein said circuit means comprises a potentiometer for setting an input voltage for said load power level control operational amplifier to thereby select said defined load power level.

20. A circuit for setting current delivered to a load as claimed in claim 11 further comprising a buffer operational amplifier connected between said voltage monitor operational amplifier and said load power level control operational amplifier.

* * * * *